US006484981B1

(12) United States Patent
Perrault

(10) Patent No.: US 6,484,981 B1
(45) Date of Patent: Nov. 26, 2002

(54) REMOVABLE LOAD SUPPORT SYSTEM

(76) Inventor: Ray Perrault, 3845 Crest Rd., Rancho Palos Verdes, CA (US) 90275

( * ) Notice: Subject to any disclaimer, the term of this patent is extended or adjusted under 35 U.S.C. 154(b) by 0 days.

(21) Appl. No.: 09/388,040

(22) Filed: Sep. 1, 1999

(51) Int. Cl.[7] ..... E04G 27/00
(52) U.S. Cl. ..... 248/218.4; 248/222.51; 248/222.52; 182/92; 403/348
(58) Field of Search ..... 248/218.4, 222.51, 248/222.52, 225.11, 219.1, 223.41, 221.11, 224.8, 223.21; 182/92; 403/348

(56) References Cited

U.S. PATENT DOCUMENTS

| | | | | | |
|---|---|---|---|---|---|
| 459,844 | A | * | 9/1891 | Thomas | 248/218.4 |
| 1,419,563 | A | * | 6/1922 | Horning | 248/218.4 |
| 1,588,566 | A | * | 6/1926 | Wismer | 248/218.4 |
| 3,497,033 | A | | 2/1970 | Herrenkohl | |
| 4,415,061 | A | * | 11/1983 | Meyer | 182/92 |
| 4,527,760 | A | * | 7/1985 | Salacuse | 248/108 |
| 4,700,807 | A | * | 10/1987 | Kubiak | 182/92 |
| 5,941,485 | A | * | 8/1999 | Davidson et al. | 248/218.4 |

OTHER PUBLICATIONS

Chance® Detachable Pole Step Assembly, Catalog No. T205–0426 (Hubbell® Power Systems CHANCE®) Rev. A 9/97.

Button–Lok stage brackets.

Safety Steps.

* cited by examiner

*Primary Examiner*—Kimberly T. Wood
(74) *Attorney, Agent, or Firm*—Howard and Howard

(57) ABSTRACT

A temporary load support system including a permanent portion comprising a stud having a stem and crosspiece, and a removable load support member comprising a cavity, configured to receive the stud and engage the crosspiece upon relative rotation of the support member relative to the stud while the stud is received in the cavity, whereby the support member is removably attached to the stud so as to enable load transfer from the support member to the stud.

57 Claims, 8 Drawing Sheets

FIG. 11
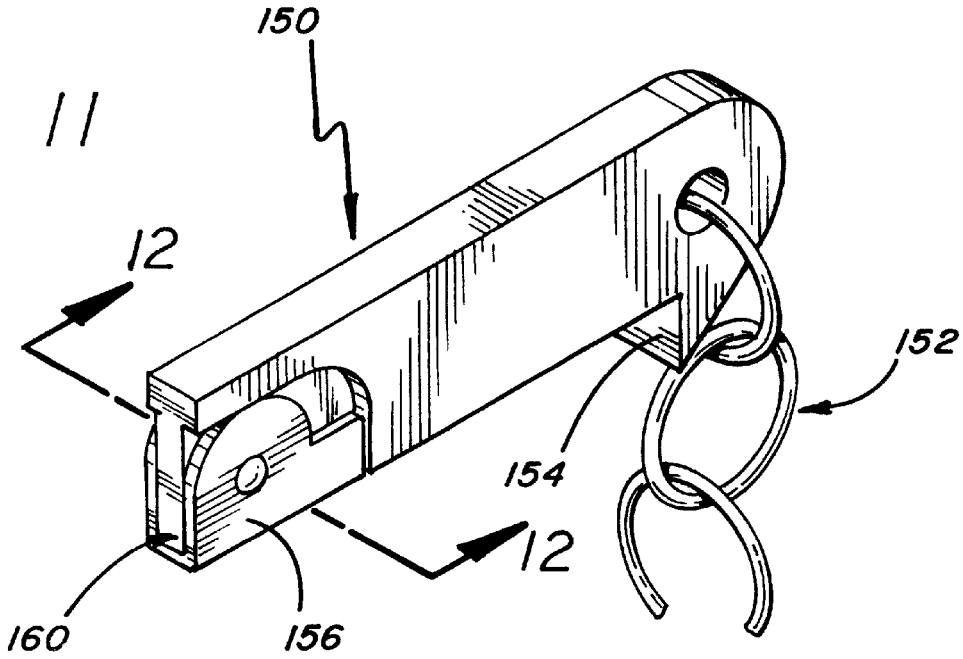
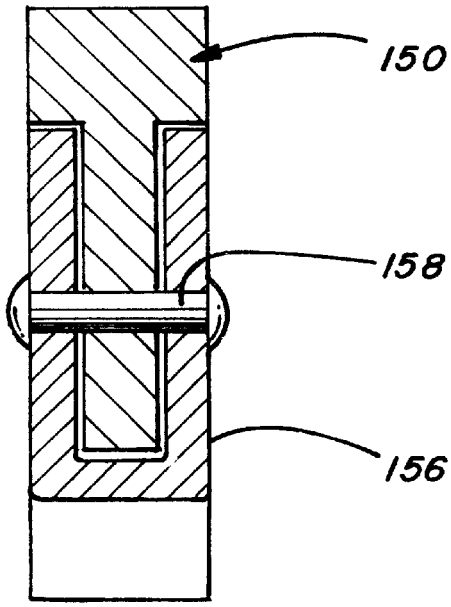
FIG. 12

REMOVABLE LOAD SUPPORT SYSTEM

BACKGROUND OF THE INVENTION

1. Field of the Invention

The invention generally relates to temporary load supports. More particularly, the invention relates to removable supports used for providing access and supporting equipment, for example, in construction, repair and inspection of facilities involving poles, towers, masts, and like structures generally extending vertically.

2. Description of the Related Art

Temporary load supports are used in many applications where it is desirable to provide access to a person or to support equipment for a short time while specific tasks are accomplished. It is desirable that such supports be removed afterwards, for example to limit access to places which are dangerous, or to reduce the risk of tampering by others. An example of one such application is providing temporary load supports adjacent side surfaces of power poles. In such applications temporary load supports may act as hand and foot holds to support the weight of a person, and may be used to support lines and/or pulleys and the like to lift equipment, to name two possible functions. The invention will be discussed in terms of such supports suitable for use with power poles, light poles, masts, towers, and the like but this is for convenience only, as the invention is not limited to such applications.

Conventionally, when wooden poles are involved, metal temporary supports can be attached by driving or screwing them into the wood of the pole. Some prior systems involved a first element which was permanently attached to the wooden pole, and a second element which was attachable to the first element, but which could be attached and removed without undue effort. This is important as it is accomplished while a linesman or other worker is ascending or descending the pole, often carrying a heavy load of equipment and/or tools. The worker attaches the temporary supports ahead as the worker climbs the pole, and removes them from below as the worker descends. An example of such a prior system is illustrated in the accompanying drawings and described in more detail below.

When a metal pole is involved, such a two part system conventionally requires the pole to be drilled and tapped for each support location. The permanent part of the system is then bolted onto the pole. This process is time consuming, and therefore costly. Moreover, the process is often done in the field. Field installation further adds to the cost, and quality cannot be controlled as well as would be the case in shop fabrication and assembly processes.

Prior two part systems conventionally work by sliding a support member, the temporary part, configured as a footrest/handhold, over the head of a screw or bolt, the bolt being a permanent part attached to the pole. A slot is provided in the support member which receives the head of the screw or bolt. The bolt can be provided with flats, and/or a raised stop provided which is received in the slot so that the support member is inhibited from rotation. This is important as gravity is what holds the support member on the bolt in such conventional systems when the support member is unloaded. If the support member rotates sufficiently, it will be able to simply slide off. A disadvantage of this system is that a worker may inadvertently snag or otherwise push a support member upward and off the bolt. The support member can strike another worker, or a bystander, below, causing injury. Also, such supports are often spaced far enough apart that inadvertent loss of even one support makes reaching between supports difficult, and this materially increases the risk of a fall. The problem is particularly acute when the worker is loaded with heavy equipment.

SUMMARY OF THE INVENTION

It has been recognized that it is desirable to provide a system in which a temporary support member does not easily come off inadvertently, and which mitigates the need for the expensive operations for attachment of the system to the pole. The invention accordingly provides a temporary load support system configured for supporting a load from an object comprising: a) a stud incorporating a stem having proximal and distal ends, carried by the object, the proximal end adjacent the object, the stud being configured to transfer a load force to the object through the proximal end; b) a crosspiece incorporated in the stud so as to transfer a load force to the stud, the crosspiece extending laterally from the stud; and c) a support member having a proximal end and a distal end and defining a slot, the support member being configured for temporary attachment to the stud at the proximal end of the support member by slipping the support member over the stud and subsequently rotating the support member to provide a mechanical interlock between the support member and the stud and crosspiece, the slot being configured to receive the crosspiece upon rotation of the support member, such that a load force can be transferred from the support member to the stud, and thereby to the object.

In a more detailed aspect, the removable load support system can further comprise a rotation inhibition interlock. Moreover, the rotation inhibition interlock can be provided by the stud and the support member each further comprising a rotation inhibiting surface, and the rotation inhibiting surfaces of the stud and support member cooperating to inhibit rotation of the support member with respect to the stud after the respective rotation inhibiting surfaces are brought together.

In a further more detailed aspect, the stud can incorporate two flats, each flat comprising a rotation inhibiting surface. The support member can comprise two cooperating surfaces comprising rotation inhibiting surfaces which cooperate with the flats to provide the rotation inhibition interlock.

In another more detailed aspect, the stud can be attached to the object by an electric weld, and further, the weld can be accomplished by directing an electric current throughout the stud and the object to heat the stud and object where they are to be welded together, whereby rapid attachment of the stud is facilitated.

In a further more detailed aspect, the removable load support system can further comprise a flange adjacent the slot defined by the support member, the flange being configured to strengthen the support member adjacent the slot. Moreover, where the support member is formed of metal plate the flange can be formed by deformation of the metal plate adjacent the slot.

In another more detailed aspect, the removable load support system can include a rotation inhibition surface incorporated in the stud and a rotation inhibition surface incorporated in the support member, the rotation inhibition surfaces cooperating to inhibit relative rotation of the support member and the stud. The support member and stud can be configured such that the rotation inhibition surfaces are engaged cooperatively to prevent rotation by a translational movement of the support member with respect to the stud after the support member has been placed over the stud and rotated to a point where the translational movement is enabled to bring the support member into interlocking relation with the stud. The direction of translational movement can be made to be parallel to a direction in which a load force is applied to the support member.

In a further more detailed aspect, the support member can be formed of a metal plate bent in a downwards U-shape defining a top portion and downwardly depending sides. The support member can further comprise a bottom connection between the sides, configured to stabilize the bottom of the sides and resist deformation comprising spreading of the sides under load.

These and other features and advantages of the invention will become more apparent from the following detailed description, taken in conjunction with the accompanying drawings.

DESCRIPTION OF THE DRAWINGS

FIG. 11 is a rotation lock in accordance with principles of the invention in one embodiment;

FIG. 12 is a cross-section view taken along line 1212 in FIG. 11 of the rotation lock show in FIG. 11;

FIG. 13 is a plan view of a sheet metal or plate metal piece after a stamping operation and before folding to form a support member in accordance with principles of the invention in one embodiment;

DETAILED DESCRIPTION OF THE PREFERRED EMBODIMENT(S)

Figure 1:
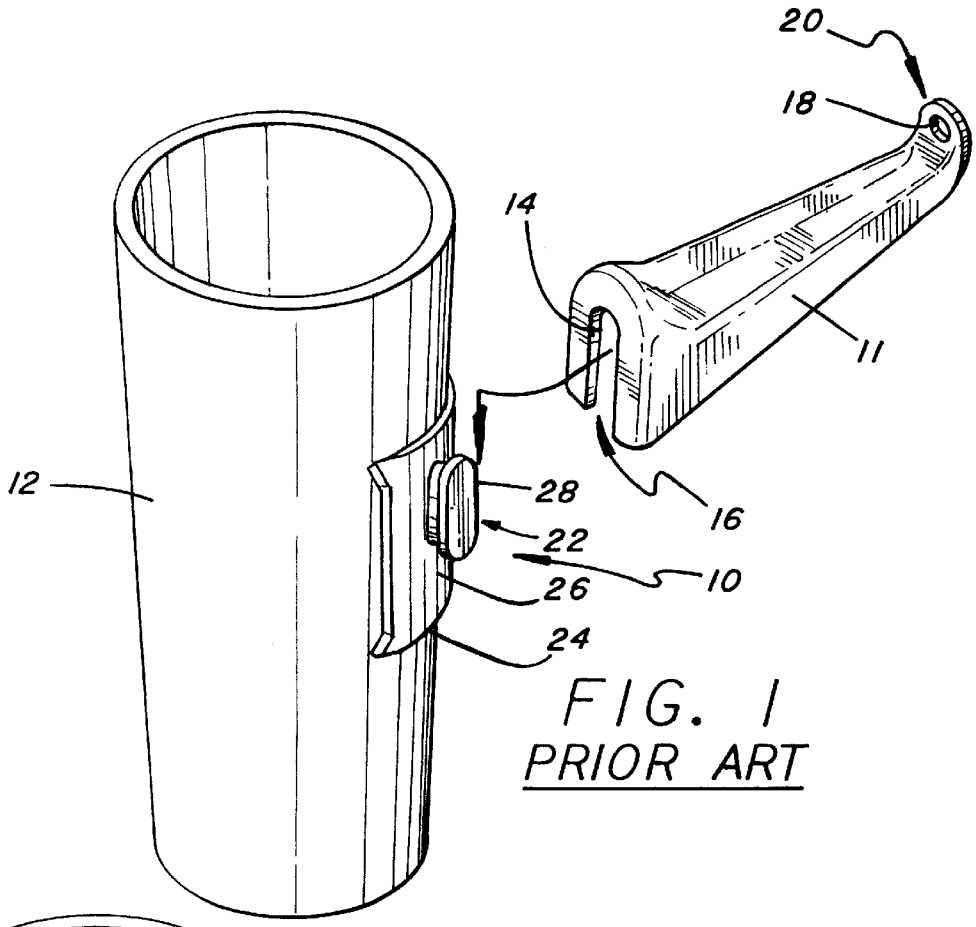
FIG. 1 PRIOR ART
FIG. 1 is a perspective view of a prior art temporary support system with a support member detached from a pole.
Figure 2:
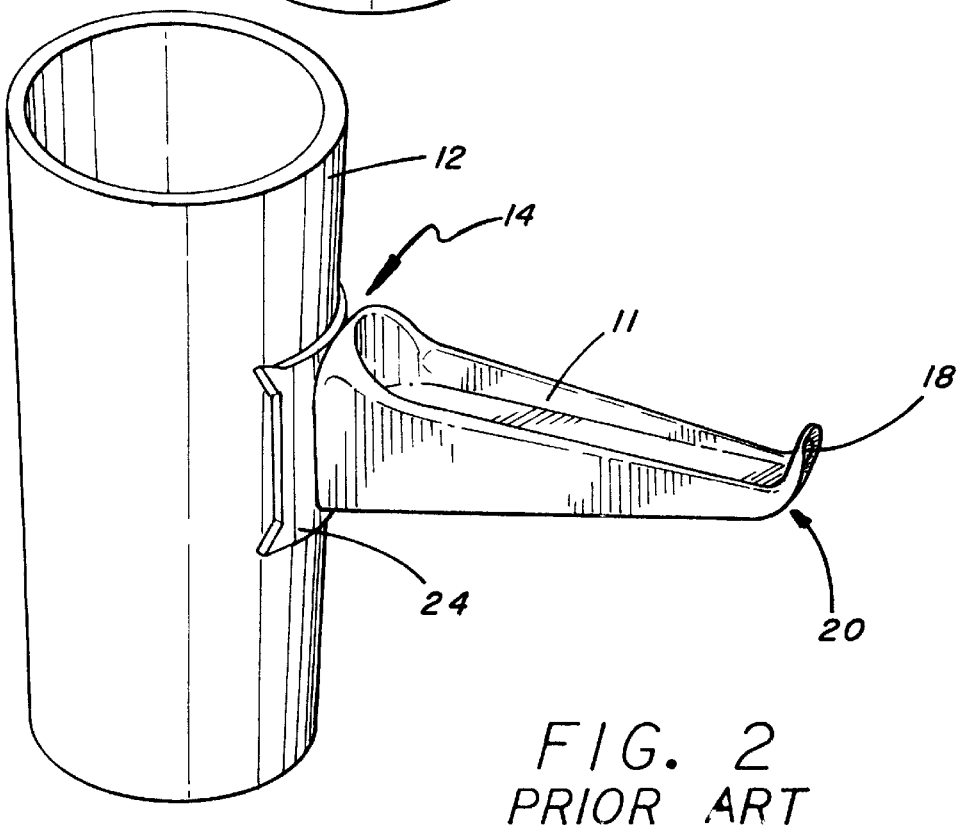
FIG. 2 PRIOR ART
FIG. 2 is a perspective view of the prior art system of FIG. 1 showing a support member ached to a pole.

With reference to FIGS. 1 and 2 of the drawings, which drawings are provided for purposes of exemplary illustration, a prior temporary support system 10 is shown. A support member 11 formed of galvanized metal is removably attachable to a pole 12. A slot 14 is provided at a proximal end 16 of the support member. A turned up portion 18, adapted to inhibit a user's foot from slipping off the support member in a direction radially outward from the pole, is provided at a distal end 20 of the support member. The support member is typically formed of metal plate, stamped and/or forged, to the shape shown.

A more permanent part of the prior art system comprises a stud 22 and a metal plate 24. These are also formed of metal, the stud having a treaded portion treaded into a tapped hole (not shown) in the pole 12. A raised portion 26 on the plate is located directly below the stud 22. The support member is slipped over the stud 22, and the stud and raised portion are received in the slot 14. The plate acts with the stud to receive and to spread out forces transferred by the support member, so as to reduce local deformation. The raised portion acts to prevent rotation of the support member 11 around the stud 22. The stud is elongated, and itself resists rotation of the support member by virtue of the slot and stud configuration, but the raised portion further assists in preventing rotation. The stud includes an enlarged head portion 28 which provides a mechanical interlock with the support member when the support member is placed over the stud and pushed down to seat thereon as shown in FIG. 2.

As will be appreciated, the prior art temporary load support system is designed so that the support member 11 can be easily placed on, and removed from, the stud 22. However, a drawback of this prior system is that the support member can also inadvertently be knocked off the stud by a force directed upward. For example, equipment being hauled upward striking the support member could potentially dislodge it. As mentioned, on utility poles, such supports are usually arranged in a staggered configuration relatively far from one another. The loss of one support member may make it difficult for a linesman to descend safely. Also a danger to persons and property below due to the possibility of being struck by a falling support member is an inherent disadvantage of the illustrated prior system.

Figure 3:
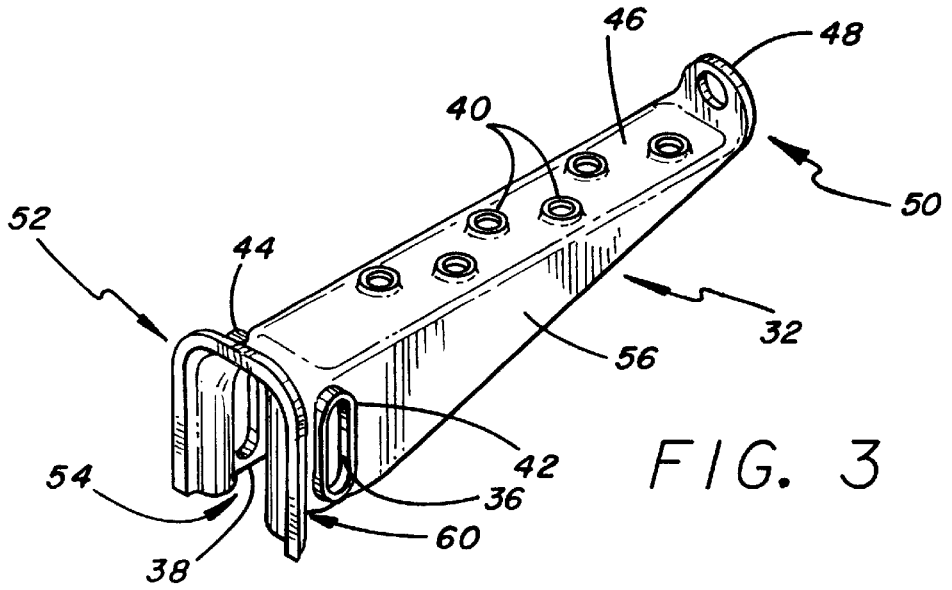
FIG. 3 is a perspective view of a support member in accordance with principles of the present invention.
Figure 4:
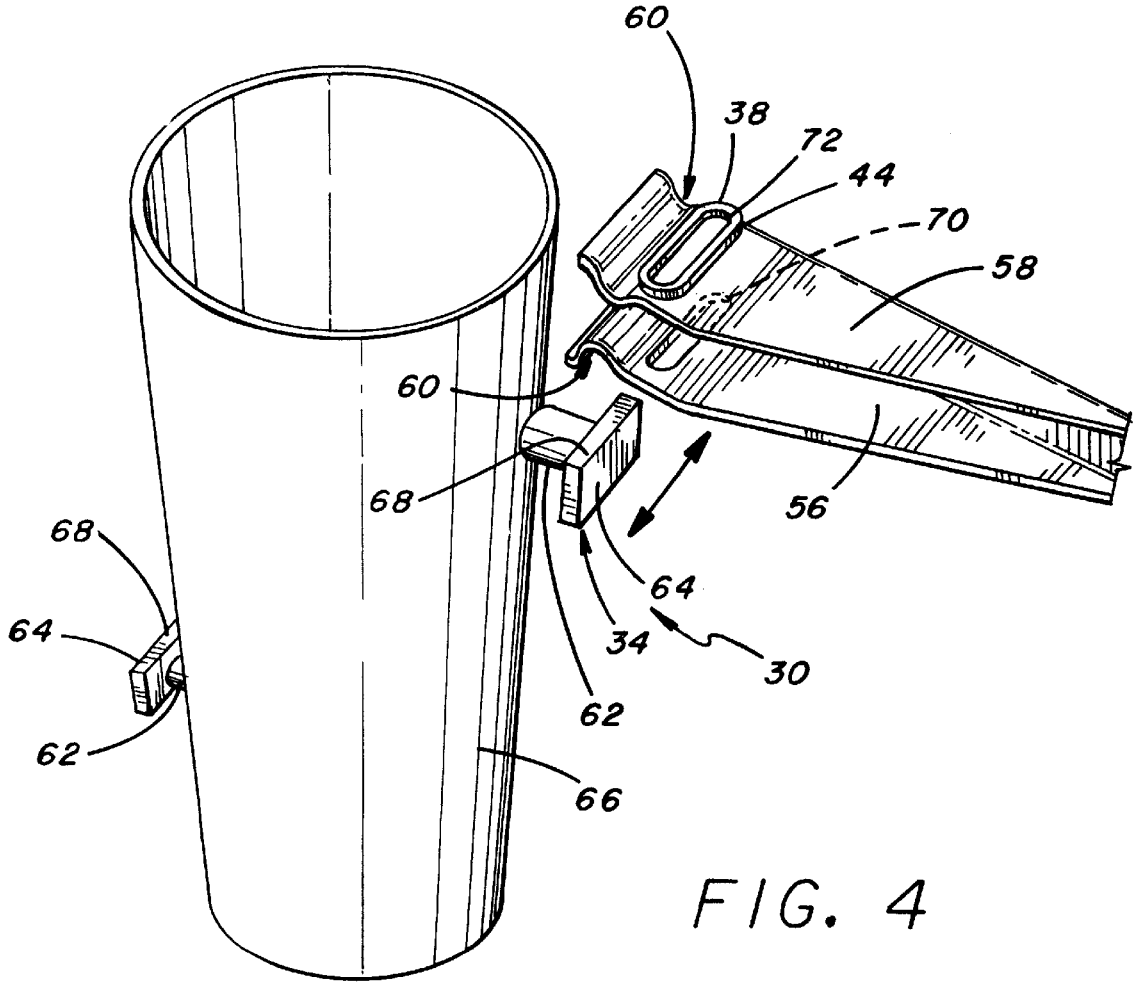
FIG. 4 is a perspective view of a temporary load support system in accordance with principles of the invention showing the support member of FIG. 3 about to be temporarily attached to a pole.

Turning now to the present invention and to FIGS. 3 and 4 in one embodiment, a temporary load support system 30 comprises a support member 32 formed of a folded plate or sheet metal material. The support member is configured to cooperate with a stud 34 which is t-shaped to provide temporary load support. The support member is attachable by placing the support member over the t-shaped stud and turning the support member to provide an interlock. Accordingly, the support member can only be attached or removed by a combination of movements comprising translation and rotation. This increases safety as it lessens the likelihood that the support member can be inadvertently knocked off the stud.

Support member can be formed of steel, steel alloy, aluminum, or aluminum alloys. If the metal used is susceptible to corrosion, the support member can be given a corrosion-resistive coating, such as galvanizing or painting the material. Metals and alloys not prone to corrosion, of course, need no coatings, but may be painted for other reasons, such as increased visibility.

The support member 32 is formed by a series of stamping operations, cutting then forming, the support member from a piece of metal plate or sheet. The support member further comprises slots 36,38 formed in the metal plate or sheet. The slots, along with tread grip portions 40, are formed by stamping the plate or sheet metal to form openings surrounded by flanges of deformed metal extending outwardly around openings in the metal which will comprise the support member 32. Flanges 42,44 surrounding the slots strengthen the support member there to resist local deformation adjacent the slots from an applied load force on the support member. As will be appreciated, the metal material comprising the flanges is locally hardened by the operation, and the geometrical configuration also further resists deformation and so lends strength to the support member in these areas.

The support member 32 is initially generally triangular in shape, and a center portion of the metal comprises a top portion 46 of the folded support member. An apex of the triangle forms a tip 48 at a distal end 50 of the completed support member 32. The tip may be folded upwards to act as a catch tending to keep the foot of a person climbing the pole, or any rope or strap draped over the temporary load support, from slipping off the distal end of the support member 32. A base of the triangle forms the proximal end 52 of the support member, and a cavity 54 is formed adjacent the proximal end of the support member within the folded plate, which is configured to receive the t-shaped stud 34.

The folded cross-section of the support member 32 comprises an upside down U-shape, with side portions 56,58 extending downwardly from the top 46 of the support member. Adjacent the proximal end 52, the support member in the illustrated embodiment is deformed to form a channel portion 60 between the proximal end 52 and the slots 36,38. This channel portion serves two functions. First, deformation of the material strengthens the support member in this area by virtue of the deformed geometry, as well as hardening of the metal due to the deformation beyond the elastic limit of the metal material. The channel portion extends into the cavity 54 adjacent the proximal end of the support member a sufficient distance that it actually or nearly comes in contact with a stem 62 of the t-shaped stud 34 when the t-shaped stud is received in the cavity as a support member is being slipped on the stud. The configuration of the channel member additionally helps to further prevent the support member from slipping off the stud by inadvertent contact from persons or objects, and also serves to stiffen the support member 32; particularly to resist outward spreading of the side portions 56,58 under an applied load force acting downward on the top 46 of the support member 32.

The t-shaped stud 34 further comprises a cross-piece 64 at a distal end of the stem 62. The cross-piece in the illustrated embodiment is rectangular in shape and can comprise a segment of plate steel welded to the stem, or preferably is formed with or joined to the stem in a casting process or forging, respectively. The t-shaped stud is attached to a pole 66 by a welding process at a proximal end of the stem 62.

In one embodiment, this welding process is a specialized arc welding process, wherein electric current is applied through the t-shaped stud 34 acting as the electrode and held stationary adjacent the pole 66. The metal is locally heated to a molten state by heat generated from an arc formed between the stud and pole, and the two are subsequently pushed together to form a weld joint. The pole and t-shaped stud are released after a weld joint forms when the molten metal material cools. This is a very rapid process, the weld being formed in less than one second generally. Such specialized welding processes for attachment of studs are known. For example, common types are referred to as "electric arc," "capacitor discharge," and "drawn arc" stud welding processes. Systems incorporating features of both the capacitor discharge and drawn arc processes are also known. As will be appreciated, this method of attachment is much faster, and therefore is more economical, than drilling and tapping the pole to provide a threaded connection.

In the illustrated embodiment the configurations of the stem 62 of the t-shaped stud 34, and the way it is attached to the pole are in accordance with such known specialized stud welding systems for attachment of similarly-configured studs, headed anchors, and the like, for other applications. Equipment and know how for welding the stud to the pole is widely commercially available, for example from TRW, Nelson Stud Welding Division, Elyria Ohio.

One of the main advantages of the system is the inherent cost savings of rapid attachment of the t-shaped studs, and this is maximized by attachment using such a specialized welding system. However, other connection means, including a threaded connection could alternatively be provided.

The t-shaped stud 34 is large in comparison with the stud used in prior systems, and is sized and configured to be more robust in resisting deformation due to handling of the pole after fabrication. In one embodiment, the t-shaped studs are attached to the pole at the factory prior to shipment to the installation site. This takes advantage of cost savings which may be realized by shop fabrication, as opposed to field attachment of the t-shaped studs. However, field attachment is also possible where an adequate power supply and suitable welding equipment is available.

Figure 5:
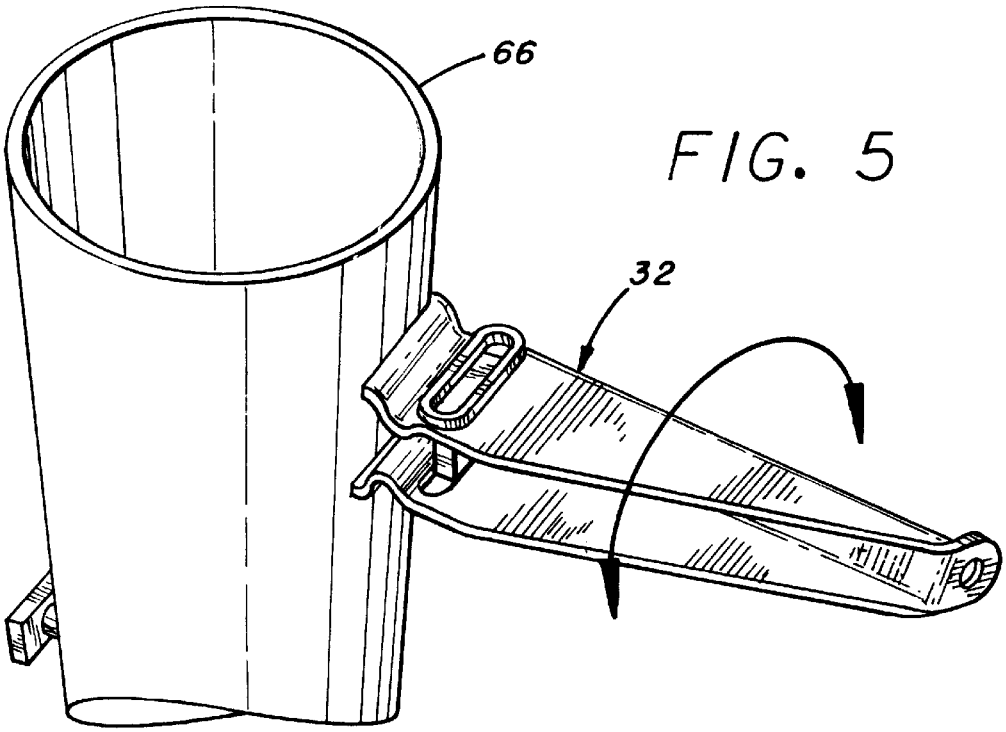
FIG. 5 is a perspective view of the system of FIG. 4 showing a second step in temporary a of a support member to a pole.
Figure 6:
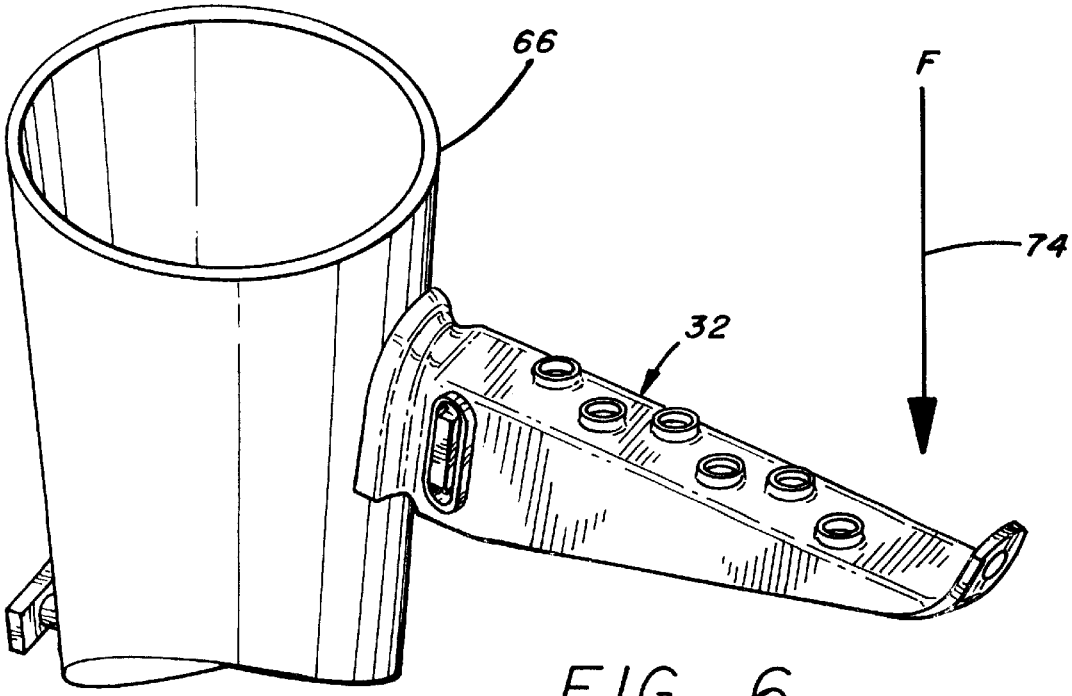
FIG. 6 is a perspective view of the system of FIG. 5 with the support member temporary attachment to the pole.

With reference to FIGS. 4, 5 and 6, the temporary load support system in accordance with principles of the invention involves slipping the support member 32 over the t-shaped stud 34 so that the stud is received in the cavity 54 at a proximal end 52 of the support member while the support member is turned on its side. The support member and t-shaped stud are configured so that when the support member is slipped over the t-shaped stud and the proximal end 52 of the support member contacts the pole 66, the cross-piece 64 is aligned with the slots 36,38 so that the support member can be rotated. Upon rotation of the support member, the cross-piece extends into the slots because of the rectangular shape of the cross-piece 64. The long dimension of the rectangle is longer than the width of the cavity 54 defined by the support member when it is upright. After rotation of the support member 32 from a sideways orientation as shown in FIGS. 4 and 5, to an upright position shown in FIG. 6, the support member is pushed downward until a top surface 68 of the cross-piece, which acts as a rotation inhibiting surface, is seated against top portions 70,72 which also comprise rotation inhibiting surfaces cooperating with the top of the cross-piece to resist relative rotation between the support member 32 and the t-shaped stud 34.

A downward acting load force F acting along line 74 in FIG. 6 is resisted by the support member 32 and the t-shaped stud 34. The base of the support member at it proximal end 52 also contacts the pole 66 and this further serves to resist the applied load force. Accordingly, load force is transferred through the support member 32 and t-shaped stud 34 to the pole 66.

Figure 7:
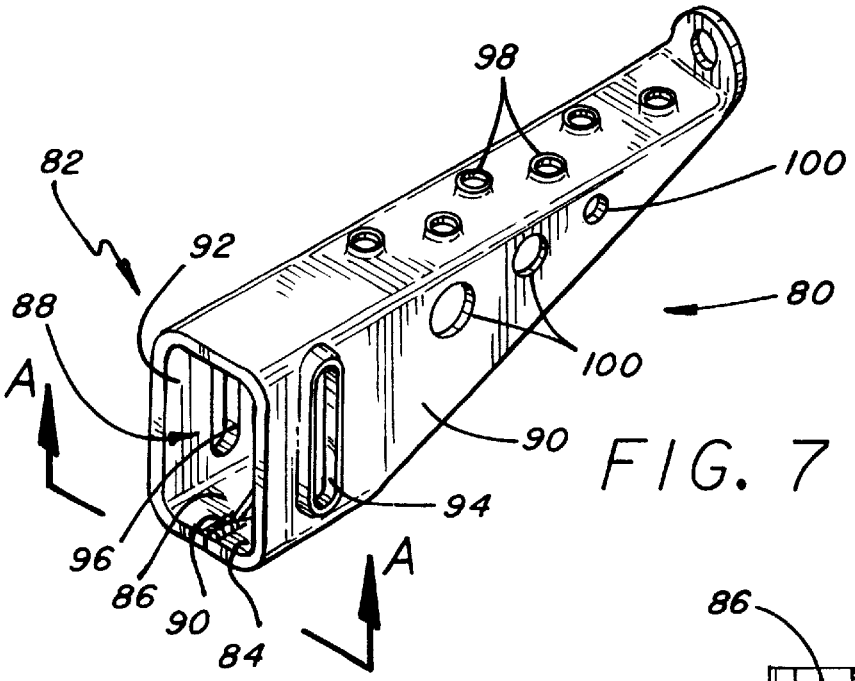
FIG. 7 is a perspective view of a support member for use with a temporary load support system in accordance with principles of the invention in another embodiment.
Figure 7A:
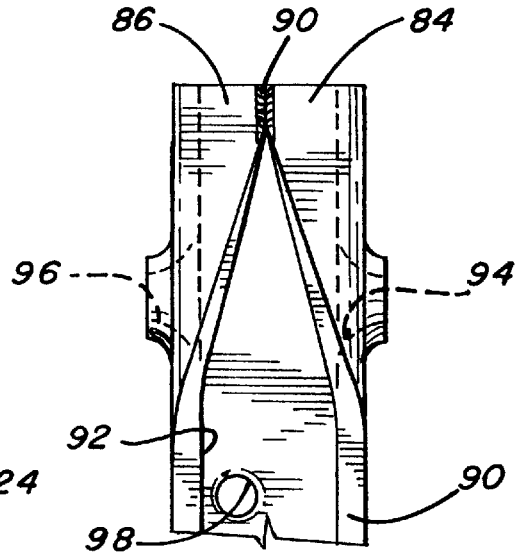
FIG. 7*a* is a perspective view of the support member of FIG. 7 taken along line AA in FIG. 7.

With reference now to FIGS. 7 and 7*a*, in another embodiment a support member 80 is configured in many respects as described above, but is stiffened against deformation at an approximal end 82 by wrapping corners 84,86 of the triangular plate or sheet metal piece around a bottom portion of a cavity 88 and joining them by a weld 90. This configuration resists spreading of sides 90,92 of the support member 80 and therefore provides a strengthened support member overall.

In addition to slots 94,96, and holes associated with tread grip portions 98 provided for increased resistance to slipping, lightening holes 100 can be punched out of the plate or sheet metal material to reduce the weight of the support member 80. This may be quite important when the support member is to be used on a very tall tower, mast, or other structure where numerous load support points will be required. Carrying these numerous support members may itself comprise a substantial burden to a user climbing the tower or other vertical member. Weight reduction mitigates this problem.

Figure 10:
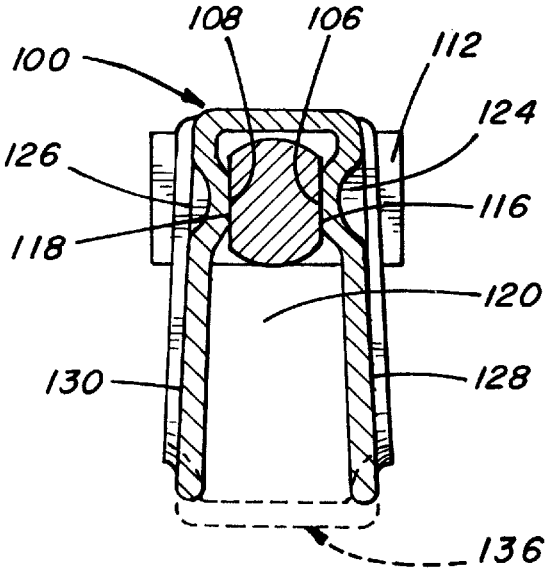
FIG. 10 is a cross-section view, taken along line 1010 in FIG. 9 of the system shown in FIG. 9.
Figure 8:
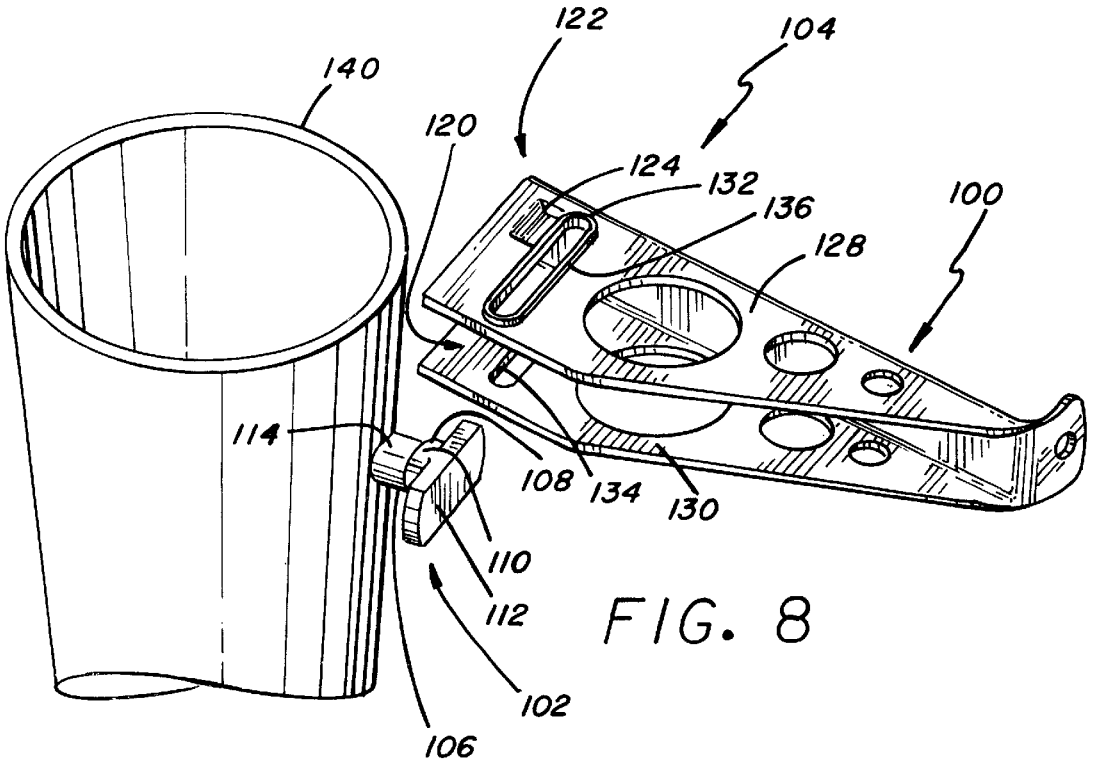
FIG. 8 is a perspective view of a temporary load support system in accordance with privies of the invention in a her embodiment, showing a support member out to be attached to the pole by placing it over a stud.
Figure 9:
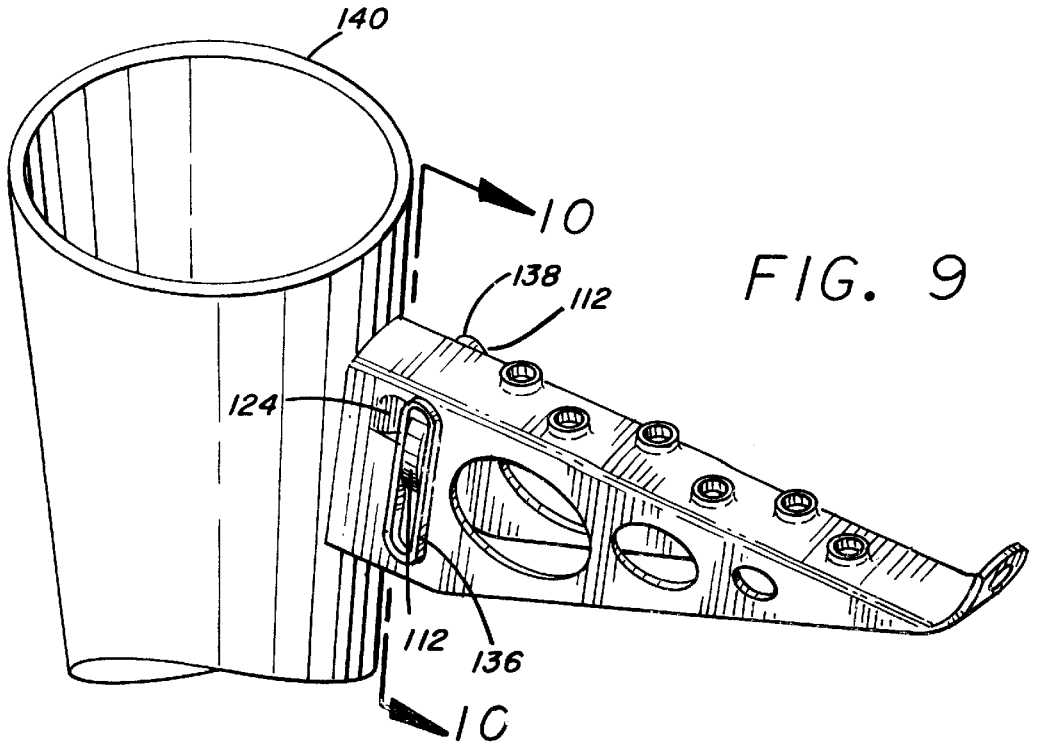
FIG. 9 is a perspective view of the system of FIG. 8 showing the support member temporarily attached to the pole.

With reference to FIGS. 8, 9 and 10, in another embodiment a rotation lock is provided which inhibits relative rotation of a support member 100 and a t-shaped stud 102 in a temporary load support system 104. The rotation lock comprises rotation inhibiting surfaces 106,108 provided on the t-shaped stud. More particularly, a collar 110 is provided adjacent a cross-piece 112 at the distal end of a stem 114 of the t-shaped stud. Otherwise, the stud is as before described. The flats cooperate with rotation inhibiting surfaces 116,118 provided on the support member 100 within the cavity 120 adjacent approximal end 122 of the support member. The rotational inhibiting surfaces provided on the interior of the support member are formed by punching the sheet metal or metal plate material inwardly to form an elongated indentation 123,126 in each side 128,130, respectively, of the support member adjacent an upper portion of the slots 132,134. The rotation inhibiting surfaces on the stud and the support member together comprise a rotation inhibiting interlock, which inhibits rotation of the support member with respect to the stud when engaged.

With this configuration, the support member 100 can be slid over the stud 102 and subsequently rotated to an upright position as before described. However, the rotation inhibiting surfaces 116,118 on the inside of the elongated indentations 124,126 prevent the support member 100 from dropping down into place over the stud until the support member is in an upright position, due to interference between the collar 110 and these inwardly extending indentations and surfaces. When the support member and stud are in proper alignment the support member drops down into interlocking relationship, and the rotation inhibiting surfaces incorporated in the stud and support member prevent rotation of the support member with respect to the t-shaped stud as long as the support member is seated downwardly so the surfaces are brought into proximity. Removal of the support member is effected by an opposite procedure where the support member is first raised in a vertical direction so that the rotation inhibiting surfaces are clear of one another, then the support member is rotated to a horizontal position, and then slid off in a horizontal direction.

With reference to FIG. 10, sufficient room is left in the cavity 120 for the cross-piece 112 to fit inside when the support member 100 is turned on its side. If a bottom closure 136 or other connection of the sides 128,130 at a bottom extent thereof is incorporated in the support member, sufficient room in the cavity 120 must be allowed to enable the cross-piece to be admitted when the support member is slid over the t-shaped stud. After the cross-piece is aligned with the slots 132,134, the support member can then be rotated and translated downwardly to lock it in place over the stud 102. The bottom closure 136 shown in FIG. 10 can be the same or similar to that discussed above in connection with FIGS. 7 and 7*a*. However, other ways of providing a connection between the sides 128,130 of the support member 100 can be used, as will be further discussed below. While such a bottom closure is unnecessary in normal use of the support member, if substantial weight is to be supported, such that the sheet or plate metal material may be stressed so as to deform, the bottom closure will provide additional load carrying capacity by resisting spreading of the sides of the support member. Another purpose for the bottom closure 136 is that it provides a further check against inadvertent disengagement of the support member 100 from the T-shaped stud 102. The flanges 136,138 surrounding the slots 132,134 also serve to stiffen and strengthen the support member as before described.

The slots 132, 134 are necessarily longer in this embodiment, as additional transitional movement of the support member 100 with respect to the stud 102 is required after rotation to an upright position. In other respects, the embodiment shown in FIGS. 8, 9 and 10, provides load support adjacent to pole 140,95 and is configured essentially as described above.

In another embodiment, rather than providing the rotation inhibiting surfaces on the collar adjacent the distal end of the stem 114 of the stud and indentations 124, 126 in the support member, with reference to FIGS. 11 and 12, a rotation lock can be provided by a separate member comprising a wedge 150 which can be inserted into the slots 132,134 below the cross-piece 112. This will prevent subsequent rotation, and accordingly, inadvertent loosening or removal of the support member from the stud. The wedge can further include a tether 152, which in the illustrated embodiment comprises a chain, connecting it to the support member 100 so that it will always be at hand for insertion when the support member is placed over the T-shaped stud in installing the temporary load support. A stop 154, combined with an overall wedge shape, prevents the wedge from being inserted too far into the slots below the cross-piece.

In one embodiment, a gravity actuated check piece 156 is rotatably affixed to an end of the wedge opposite the stop 154 and acts as a lock. The check piece drops down after insertion of the wedge through the slots, preventing it from being inadvertently removed. A user pushes the check piece back up with a finger in order to enable removal of the wedge from the slots 132,134, when removal of the support member is desired. The check piece comprises a folded piece of metal rotating about a pin 158. A leading end of the wedge is rounded at a bottom portion to accommodate downward rotation of the check piece leading end 160.

Figure 14:
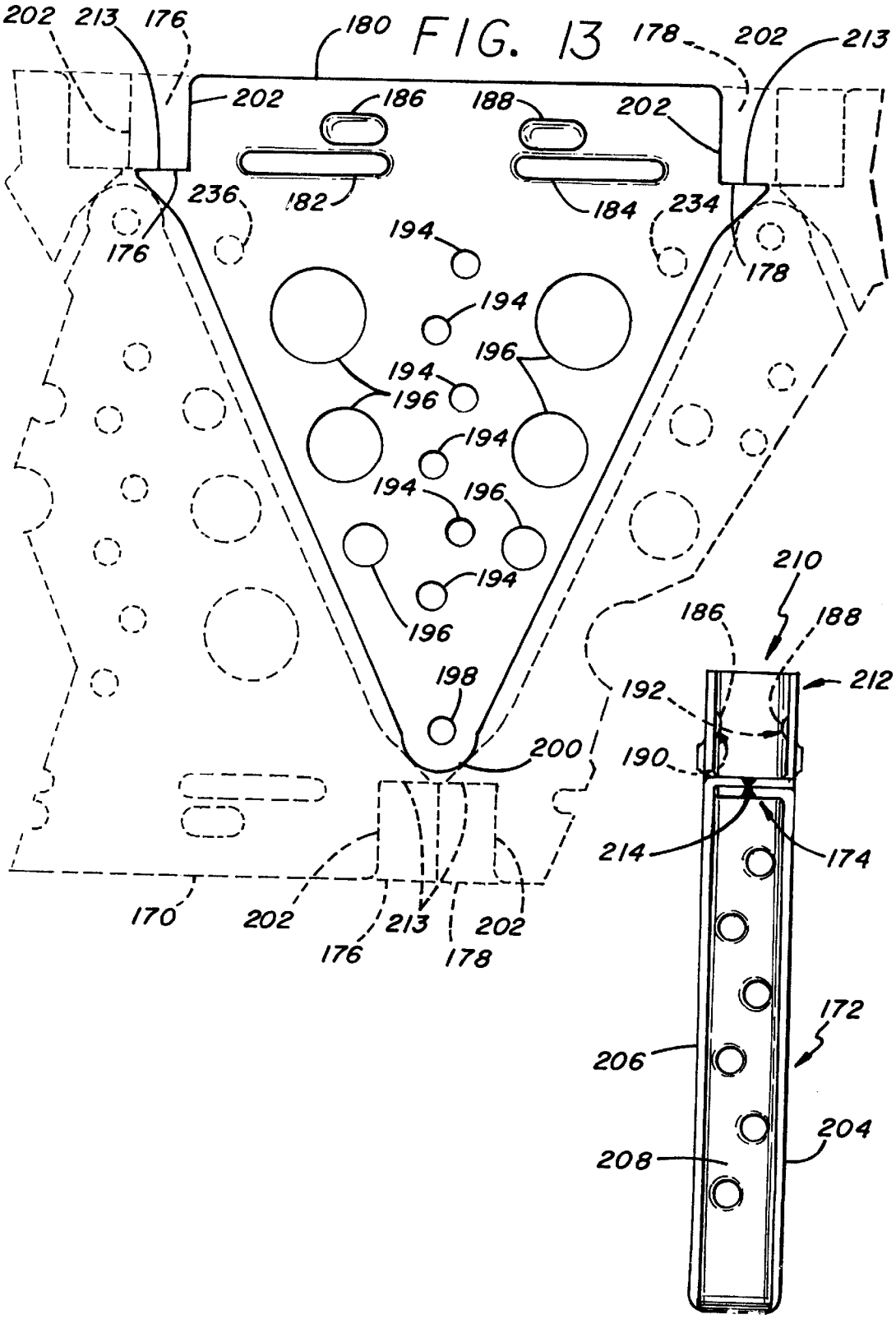
FIG. 14 is a bottom view of a support member folded from a blank shown in FIG. 13.

With reference to FIGS. 13 and 14, in another embodiment load support pieces 180 are cut from a plate or sheet of metal 170 to form a load support member 172 as before described. The illustrated embodiment differs in that a bottom connection 174 is provided by cutting tabs adjacent base corners 176, 178 adjacent corner portions of the triangular piece 180.

Features of the support member 172 can be formed by a stamping process, including: slots 182,184; elongated indentations 186,188 if they are provided, and which act as rotation inhibiting surfaces 190,192; tread grip portions 194; lightening holes 196; and a hole 198 facilitating easier upward bending of a tip portion 200 of the support member 172. In the illustrated embodiment cuts 202 form the tabs 176,178 mentioned above. The triangular piece 180 can subsequently be folded to form side portions 204,206 and the top portion 208 of the support member 172. In support members where elongated indentations 186,188 are used to provide rotation inhibiting surfaces 190,192, as an alternative to forming these exclusively by stamping before folding, a die (not shown) can be inserted into the cavity adjacent approximal end 212 of the folded support member and the elongated indentations stamped inwardly from both sides. This latter option can be done where a close tolerance is desired in the distance between the rotation inhibiting surfaces. Moreover, the die can be sized to create flat surfaces on the inner-most portions of the elongated indentations spaced apart from each other as desired to provide a small clearance between the support member 172 and a t-shaped stud at the location of rotation inhibiting surfaces formed in the respective members.

Turning again to FIGS. 13 and 14 more particularly, the bottom connection 174 is effected by bending tabs 176,178 downwardly about fold lines 213, before bending the sides 204,206 down. The tabs are bent down so that they will overlap in the completed support member 172. The tabs can subsequently be attached, for example by a spot weld 214, or other welding process, to resist shear forces. Such shear forces will be applied as the sides 204,206 tend to spread under application of a load force on the support member.

Figure 15:
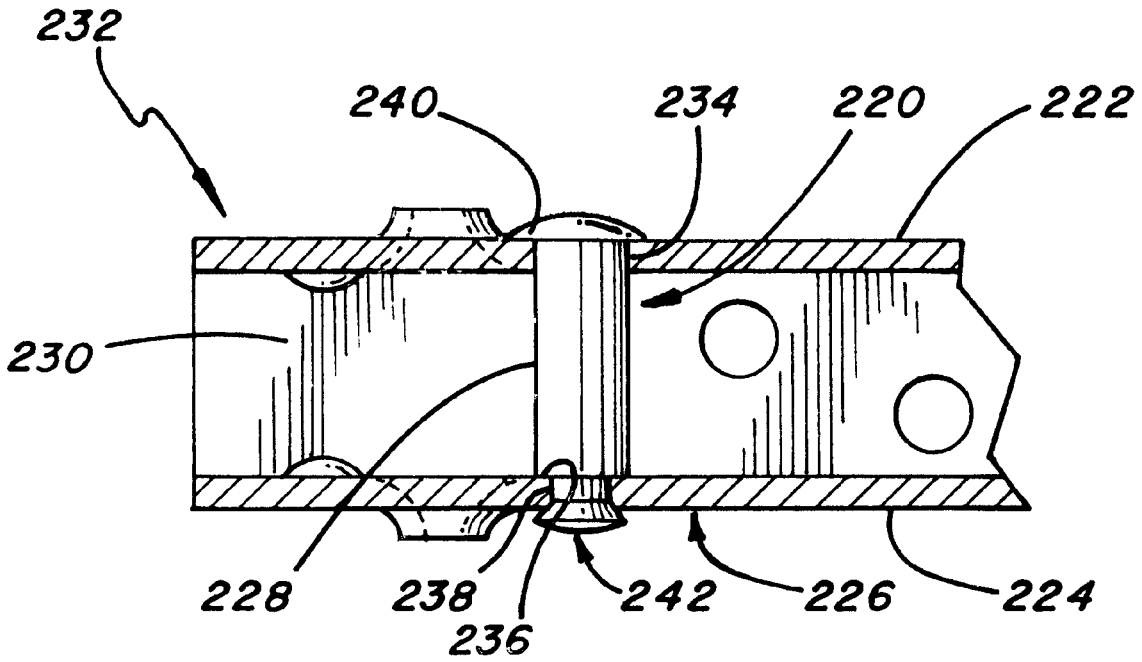
FIG. 15 is a bottom view, partially in cross-section, showing a support member in another embodiment of the invention.

With reference to FIG. 15, in a further embodiment, a bottom connection 220 between sides 222,224 of a support member 226 is provided by a pin 228. The pin is located adjacent to, but distal of the cavity 230 adjacent the proximal end 232 of the support member which receives the t-shaped stud. Holes (234,236 in FIG. 13) are provided in the plate or sheet metal to accommodate the pin. With reference to FIG. 15, the upper hole 234 is of larger diameter than the lower hold 236. The pin is provided with a shoulder 238 and head 240 which cooperate to seat the pin when it is inserted in the holes. A smaller diameter end portion 242 extends through the lower hole 236 and is thereafter swaged to lock the pin in place.

Again, the bottom connection shown in the drawings and discussed in various embodiments above is provided to give an increased margin of safety, and is redundant in all cases except severe overloading of the support system.

From the foregoing, it will be apparent that an improved temporary and removable load support system is provided in accordance with principles of the invention. Safety is increased as it is more difficult to inadvertently remove the support member from the pole. Manufacturing costs are decreased by use of the fabrication methods discussed above. Further, a removable load support system in accordance with the invention provides a greater load carrying capacity than the prior system, these reasons demonstrating a substantial step forward in the art.

Numerous variations and improvements can be made to the system of the invention without departing from the spirit and scope thereof. It is not intended that the invention be limited to the embodiments disclosed above as illustrative examples. Furthermore, it is not intended that the language of the appended claims include means plus function language, or be construed as such, or otherwise so as to invoke 35 U.S.C. § 112, 6th paragraph, or to otherwise limit the scope of the claims to the disclosed embodiment(s) and equivalents. The embodiments disclosed are examples of how the invention can be implemented, but the invention is broader in scope than specific examples given.

I claim:

1. A removable load support system configured to support a load at a point adjacent a side surface of a pole, comprising:

a t-shaped stud affixed to the pole and extending out from the surface in a direction substantially normal to the surface, the t-shaped stud including:

a stem portion extending in a direction substantially normal to the surface, the stem having a base portion comprising a portion of the t-shaped stud proximal to the surface and attached to the surface so as to transfer a load force to the pole, and a crosspiece carried by the stem portion so as to enable load forces to be transferred from the crosspiece to the stem portion, the crosspiece extending laterally from the stem portion to form a t-shaped stud; and a removable support member having proximal and distal ends, the removable support member being configured at the proximal end to releasably attach to the t-shaped stud so as to transfer a load force from the support member to the t-shaped stud, the support member defining a cavity adjacent its proximal end configured to receive the t-shaped stud when the support member is slipped over the t-shaped stud and the proximal end of the support member is brought adjacent the surface, the support member further defining a first slot and a second slot configured to align with and receive the crosspiece as the support member is tamed on the t-shaped stud, the removable support being attachable to the t-shaped stud by sliding over the t-shaped stud and rotating the removable support so that the crosspiece of the t-shaped stud is received in the slots.

2. The removable load support system of claim 1, wherein the t-shaped stud and the support member each further comprise a rotation inhibiting surface, the rotation inhibiting surface of the support member and the rotation inhibiting surface of the t-shaped stud cooperating to inhibit rotation of the support member with respect to the t-shaped stud, inadvertent rotation and separation of the support member from the t-shaped stud being thereby inhibited.

3. The removable load support system of claim 1, further comprising a rotation lock.

4. The removable load support system of claim 3, wherein the rotation lock further comprises opposing rotation inhibiting surfaces incorporated in the support member, and corresponding rotation inhibiting surfaces incorporated in the t-shaped stud, the support member and the t-shaped stud being configured to allow relative translational and rotational movement when the cross piece is received in the slot; translational movement moving the rotation inhibiting surfaces incorporated in the support member into facing relationship with the corresponding rotation inhibiting surfaces incorporated in the t-shaped stud.

5. The removable load support system of claim 3, wherein the rotation lock further comprises a wedge configured to be inserted into a slots after the crosspiece is received in the slots to prevent the support member from rotating a sufficient amount to allow separation from the t-shaped stud.

6. The removable load support system of claim 5, further comprising a releasable lock releasably holding the wedge in the slot.

7. The removable load support system of claim 4, wherein the support member is rotated on the t-shaped stud and subsequently translated in substantially a direction in which the load is applied to the support to engage the rotation lock.

8. The removable load support system of claim 7, wherein rotation inhibiting surfaces of the t-shaped stud comprise flats located adjacent the crosspiece.

9. The removable load support system of claim 1, wherein the t-shaped stud is attached to the side surface of the pole by welding.

10. The removable load support system of claim 9, wherein the welding is accomplished by applying an electric current through the t-shaped stud and the pole.

11. The removable load support system of claim 10, wherein the welding further comprises formation of an arc between the t-shaped stud and the pole, heating the pole and t-shaped stud, and subsequently joining the t-shaped stud and the pole while heated.

12. The removable load support system of claim 1, wherein the support member is formed of metal plate.

13. The removable load support system of claim 12, wherein the metal plate is folded to form a U-shape, the U-shape being upside down when the support member is mounted on the pole and comprising a top portion and downwardly extending side portions.

14. The removable load support system of claim 13, further comprising a bottom connection configured to resist spreading of sides of the support member under load.

15. The removable load support system of claim 14, wherein the bottom connection further comprises a further folding of the metal plate form an O-shaped cross section of the support member adjacent the proximal end of the support member.

16. The removable load support system of claim 15, wherein the bottom connection further comprises a pin.

17. The removable load support system of claim 12, wherein the support member defines weight-saving openings.

18. The removable load support system of claim 1, further comprising a flange adjacent the slot configured to strengthen the support member adjacent the slot to resist local deformation of the support member adjacent the slot when a load force is applied to the support member.

19. The removable load support system of claim 18, wherein the support member is formed of metal plate and the flange is formed by bending deformation of the plate adjacent the slot.

20. The removable load support system of claim 1, wherein the support member is configured to act as a foot step.

21. The removable load support system of claim 20, wherein the support member further comprises raised tread portions configured to inhibit slipping of a foot with respect to the support member.

22. The removable load support system of claim 12, wherein the metal plate is shaped substantially as a triangle.

23. The removable load support system of claim 22, further comprising a bottom connection formed by welding to corners of the triangle shaped plate together adjacent the proximal end of the support member.

24. The removable load support system of claim 14, wherein the bottom connection comprises a folded portion of the metal plate.

25. A removable load support system configured to support a load adjacent a surface extending vertically, comprising:

a t-shaped stud affixed to the surface, the t-shaped stud further comprising a stem having a base at a proximal end attached to the surface and a distal end, and a crosspiece attached to the stem at the distal end, the cross piece having a length dimension greater than the width of the stem and extending substantially horizontally from the stem on both sides, a removable support member having proximal and distal ends and engageable with the t-shaped stud, the removable support member defining a cavity at the proximal end configured to receive the t-shaped stud, and further comprising first and second slots opening on the cavity which are engageable with the t-shaped stud by placing the removable support over the t-shaped stud and rotating the removable support so that the cross piece of the t-shaped stud extends into the slots and thereby mechanically engages the removable support, whereby a load force can be transferred from the support member to the t-shaped stud attached to the surface.

26. The removable load support system of claim 25, wherein the support member further comprises flanges adjacent the first and second slots, the flanges being configured to stiffen the support member adjacent the slots to provide increased resistance to deformation of the support member due to application of a load force.

27. The removable load support system of claim 25, wherein the t-shaped stud further comprises a first rotation inhibiting surface and the support member further comprises a second rotation inhibiting surface cooperating with the first rotation inhibiting surface to inhibit rotation of the support member with respect to the t-shaped stud.

28. The removable load support system of claim 27, wherein the t-shaped stud and the support member are configured so that the first and second rotation inhibiting surfaces are brought into contact by translating motion of the support member in a direction substantially the same as that of application of the load force, the surfaces being engaged after rotation of the support member with respect to the t-shaped stud so that the cross piece is received in the slots by said translating motion by pushing the support member in the direction of load application.

29. The removable load support system of claim 28, wherein the first rotation inhibiting surface comprises a flat portion of the stem and the second rotation inhibiting surface comprises a portion of the support member extending into the cavity at the proximal end of the support member.

30. The removable load support system of claim 25, further comprising a rotation lock.

31. The removable load support system of claim 30, wherein the rotation lock further comprises opposing rotation inhibiting surfaces incorporated in the support member, and corresponding rotation inhibiting surfaces incorporated in the t-shaped stud, the support member and the t-shaped stud being configured to allow relative translational and rotational movement when the cross piece is received in the slot, translational movement moving the rotation inhibiting surfaces incorporated in the support member into facing relationship with the corresponding rotation inhibiting surfaces incorporated in the t-shaped stud.

32. The removable load support system of claim 3, wherein the rotation lock further comprises a wedge configured to be inserted into a slots after the crosspiece is received in the slot to prevent the support member from rotating a sufficient amount to allow separation from the t-shaped stud.

33. The removable load support system of claim 5, further comprising a releasable lock releasably holding the wedge in the slot.

34. The removable load support system of claim 31, wherein the support member is rotated on the t-shaped stud and subsequently translated in substantially a direction in which the load is applied to the support to engage the rotation lock.

35. The removable load support system of claim 34, wherein rotation inhibiting surfaces of the t-shaped stud comprise flats located adjacent the crosspiece.

36. The removable load support system of claim 35, wherein the t-shaped stud is attached to the side surface of the pole by welding.

37. The removable load support system of claim 36, wherein the welding is accomplished by applying an electric current through the t-shaped stud and the pole.

38. The removable load support system of claim 25, wherein the support member is formed of metal plate.

39. The removable load support system of claim 38, in the metal plate is folded to form a U-shape, the U-shape being upside down when the support member is mounted on the pole and comprising a top portion and downwardly extending side portions.

40. The removable load support system of claim 39, further comprising a bottom connection configured to resist spreading of sides of the support member under load.

41. The removable load support system of claim 12, wherein the support member defines weight-saving openings.

42. The removable load support system of claim 26, wherein the support member is formed of metal plate and the flange is formed by bending deformation of the plate adjacent the slot.

43. The removable load support system of claim 25, wherein the support member is configured as a foot step support.

44. The removable load support system of claim 43, wherein the support member further comprises raised tread grip portions configured to inhibit slipping of a foot with respect to the support member.

45. The removable load support system of claim 25, wherein the support member is formed of a metal plate initially shaped substantially as a triangle.

46. The removable load support system of claim 45, wherein the bottom connection comprises a folded portion of the metal plate.

47. A removable load support system configured for supporting a load from an object comprising:

a stud incorporating a stem having proximal and distal ends, carried by the object, the proximal end adjacent the object, the stud being configured to transfer a load force to the object through the proximal end;

a crosspiece incorporated in the stud so as to transfer a load force to the stud, the crosspiece extending laterally from the stud;

a support member having a proximal end and a distal end and defining a slot, the support member being configured for temporary attachment to the stud at the proximal end of the support member by slipping the support member over the stud and subsequently rotating the support member to provide a mechanical interlock between the support member and the stud and crosspiece, the slot being configured to receive the crosspiece upon rotation of the support member, such that a load force can be transferred from the support member to the stud, and thereby to the object.

48. The removable load support system of claim 47, further comprising a rotation inhibition interlock.

49. The removable load support system of claim 48, wherein the rotation inhibition interlock is provided by the stud and the support member each further comprising a rotation inhibiting surface, and the rotation inhibiting surfaces of the stud and support member cooperating to inhibit rotation of the support member with respect to the stud after the respective rotation inhibiting surfaces are brought together.

50. The removable load support system of claim 49, wherein the stud incorporates two flats, each flat comprising a rotation inhibiting surface, and the support member comprises two cooperating surfaces comprising rotation inhibiting surfaces which cooperate with the flats to provide the rotation inhibition interlock.

51. The removable load support system of claim 47, wherein the stud is attached to the object by an electric weld.

52. The removable load support system of claim 47, further comprising a flange adjacent the slot defined by the support member, the flange being configured to strengthen the support member adjacent the slot.

53. The removable load support system of claim 52, wherein the support member is formed of metal plate, and the flange is formed by deformation of the metal plate adjacent the slot.

54. The removable load support system of claim 47, further comprising a rotation inhibition surface incorporated in the stud and a rotation inhibition surface incorporated in the support member, the rotation inhibition surfaces cooperating to inhibit relative rotation of the support member and the stud, the support member and stud being configured such that the rotation inhibition surfaces are engaged cooperatively to prevent rotation by a translational movement of the support member with respect to the stud after the support member has been placed over the stud and rotated to bring the support member into interlocking relation with the stud.

55. The removable load support system of claim 54, wherein the direction of translational movement is parallel to a direction in which a load force is applied to the support member.

56. The removable load support system of claim 47, wherein the support member is formed of a metal plate bent in a downwards U-shape defining a top portion and downwardly depending sides.

57. The removable load support system of claim 56, wherein the support member further comprises a bottom connection between the sides configured to stabilize the bottom of the sides and resist deformation comprising spreading of the sides under load.

* * * * *